US008162810B2

(12) United States Patent
Ozawa et al.

(10) Patent No.: US 8,162,810 B2
(45) Date of Patent: Apr. 24, 2012

(54) SADDLE FOR EXERCISE EQUIPMENT AND EXERCISE EQUIPMENT USING THE SAME

(75) Inventors: Takahisa Ozawa, Hikone (JP); Youichi Shinomiya, Ibaraki (JP); Kazuhiro Ochi, Osaka (JP)

(73) Assignee: Panasonic Corporation, Kadoma-shi (JP)

( * ) Notice: Subject to any disclaimer, the term of this patent is extended or adjusted under 35 U.S.C. 154(b) by 0 days.

(21) Appl. No.: 10/581,266

(22) PCT Filed: Dec. 2, 2004

(86) PCT No.: PCT/JP2004/017926

§ 371 (c)(1),
(2), (4) Date: Jun. 1, 2006

(87) PCT Pub. No.: WO2005/053799

PCT Pub. Date: Jun. 16, 2005

(65) Prior Publication Data

US 2007/0123401 A1 May 31, 2007

(30) Foreign Application Priority Data

Dec. 5, 2003 (JP) ..... 2003-407972

(51) Int. Cl.

| | |
|---|---|
| ***A63B 21/068*** | (2006.01) |
| ***A63B 22/00*** | (2006.01) |
| ***A63B 26/00*** | (2006.01) |
| ***A63B 71/00*** | (2006.01) |
| ***A61H 1/00*** | (2006.01) |
| ***A61H 1/02*** | (2006.01) |
| ***A61H 5/00*** | (2006.01) |

(52) U.S. Cl. ..... 482/142; 482/95; 482/51

(58) Field of Classification Search ..... 482/34–36, 482/51, 57, 75, 77, 79, 91, 92, 95, 96, 123, 482/130, 131, 133, 142, 145, 147; 601/24, 601/26, 90, 91, 23, 33–36; 297/195.1, 201, 297/215.13, 311, 313–314, 330; 434/247; 472/95–97; *A61B 21/068, 22/00, 26/00, A61B 71/00; A61H 1/00, 5/00*

See application file for complete search history.

(56) References Cited

U.S. PATENT DOCUMENTS 3,480 A * 3/1844 Halsted ..... 601/90

(Continued)

FOREIGN PATENT DOCUMENTS

AT 394806 6/1992

(Continued)

OTHER PUBLICATIONS

Supplemental European Search Report, dated Dec. 15, 2008, issued on the corresponding European Patent No. 04819884.0.

*Primary Examiner* — Loan Thanh
*Assistant Examiner* — Oren Ginsberg
(74) *Attorney, Agent, or Firm* — Edwards Wildman Palmer LLP

(57) ABSTRACT

A saddle for an exercise equipment for allowing a user to perform an exercise in a sitting posture is provided, which has the capability of suppressing variations in sitting posture to achieve stable exercise effects. The exercise equipment has a base, the saddle for supporting the user's buttocks, and a coupling mechanism configured to movably couple the saddle to the base such that a load acted on a leg by the user's own weight varies according to a relative positional displacement between a foot position and a position of center of gravity of the user, and also configured to limit a movable direction of the saddle such that a direction of the relative positional displacement between the foot position and the position of center of gravity is limited to a direction of flexion and extension of knee joint. The saddle has a pair of curved recesses at its outer periphery, which are configured such that parts of the femoral regions of the user fit the recesses.

13 Claims, 5 Drawing Sheets

U.S. PATENT DOCUMENTS

| | | | | | |
|---|---|---|---|---|---|
| 483,266 | A | | 9/1892 | Schindler | |
| 604,347 | A | | 5/1898 | Bray | |
| 608,682 | A | * | 8/1898 | Jamieson | 297/201 |
| 1,283,210 | A | * | 10/1918 | Kinney | 482/142 |
| 2,707,465 | A | * | 5/1955 | Nemeth | 601/87 |
| 3,432,162 | A | * | 3/1969 | Flemming | 482/77 |
| 3,463,145 | A | * | 8/1969 | Whitaker | 601/5 |
| 4,130,263 | A | | 12/1978 | Roericht | |
| 4,332,381 | A | * | 6/1982 | Lyons | 482/140 |
| 5,094,450 | A | * | 3/1992 | Stearns | 482/130 |
| 5,242,356 | A | * | 9/1993 | Grenfell | 482/142 |
| 5,728,049 | A | * | 3/1998 | Alberts | 601/24 |
| 5,810,751 | A | * | 9/1998 | Meier et al. | 601/24 |
| 6,189,908 | B1 | * | 2/2001 | Lu | 280/284 |
| 6,193,315 | B1 | | 2/2001 | Hoshino | |
| 6,357,825 | B1 | * | 3/2002 | Bavaresco | 297/201 |
| 6,422,647 | B1 | | 7/2002 | Turudich | |
| 6,558,304 | B1 | | 5/2003 | Bardon et al. | |
| 6,644,742 | B1 | | 11/2003 | Walser | |
| 2001/0008348 | A1 | | 7/2001 | Nelson | |
| 2002/0058891 | A1 | * | 5/2002 | Hood et al. | 601/26 |
| 2002/0115536 | A1 | * | 8/2002 | Hojo et al. | 482/51 |
| 2002/0163231 | A1 | | 11/2002 | Hoshino | |
| 2003/0038515 | A1 | | 2/2003 | Martin et al. | |

FOREIGN PATENT DOCUMENTS

| | | |
|---|---|---|
| DE | 19734742 | 2/1999 |
| EP | 0878216 | 11/1998 |
| EP | 1334675 | 8/2003 |
| FR | 2769510 | 4/1999 |
| JP | 5-329226 | 12/1993 |
| JP | 11-155836 | 6/1999 |
| JP | 2000-245567 | 9/2000 |
| JP | 2002-328674 | 11/2002 |
| WO | WO-97/25107 | 7/1997 |
| WO | WO-00/00379 | 1/2000 |

* cited by examiner

FIG. 1
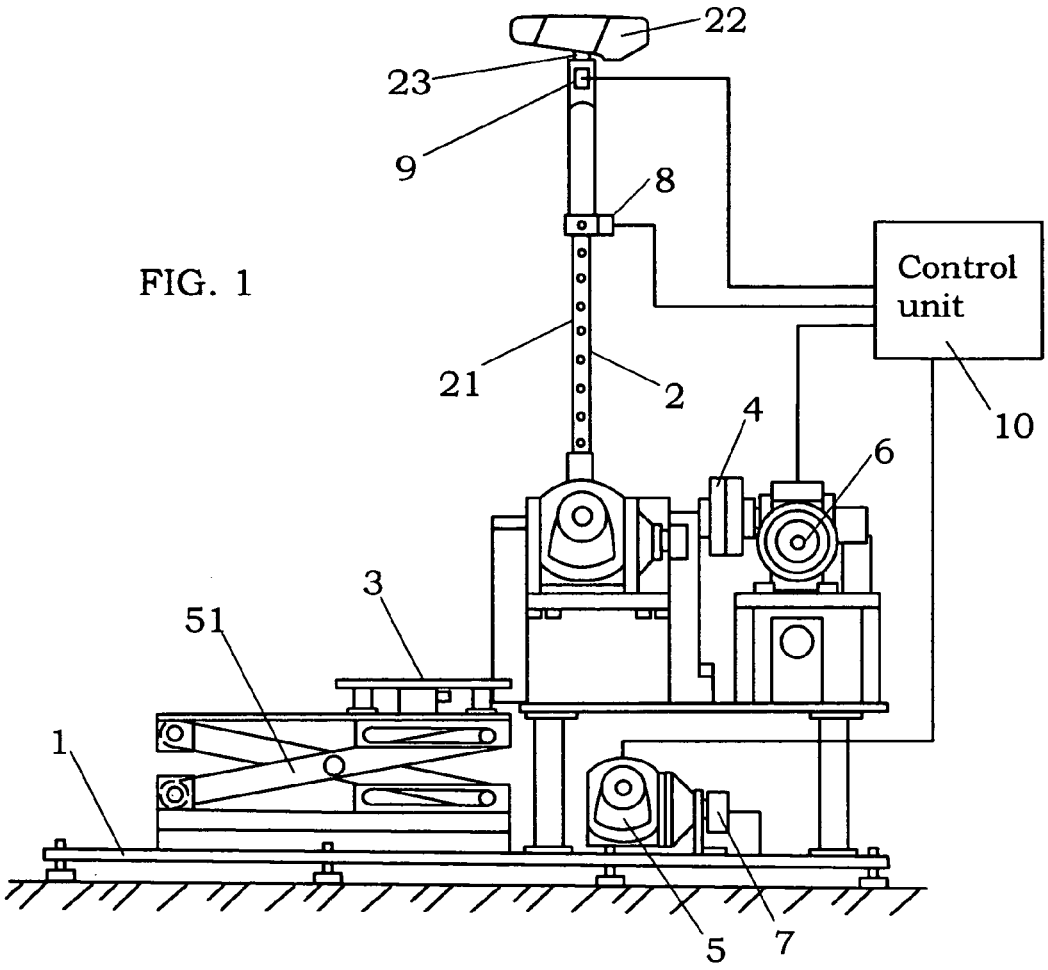
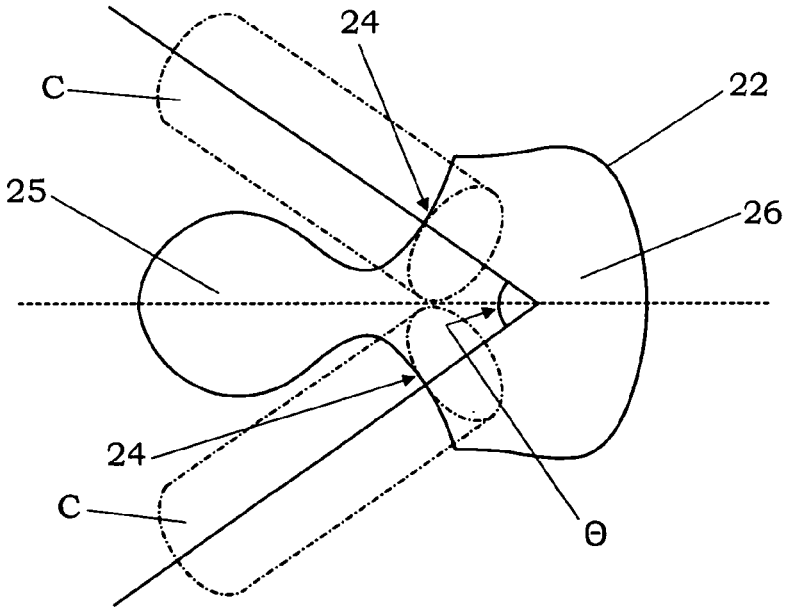
FIG. 2

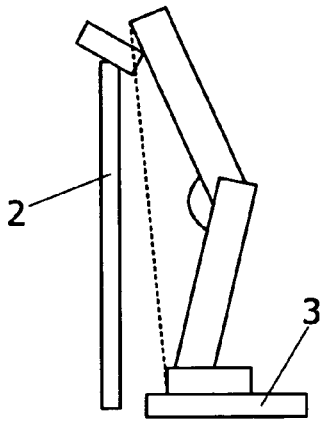
FIG. 5A
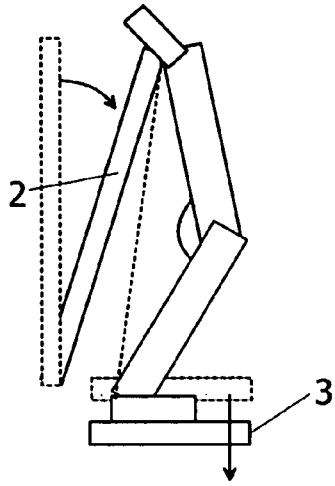
FIG. 5B
FIG. 6
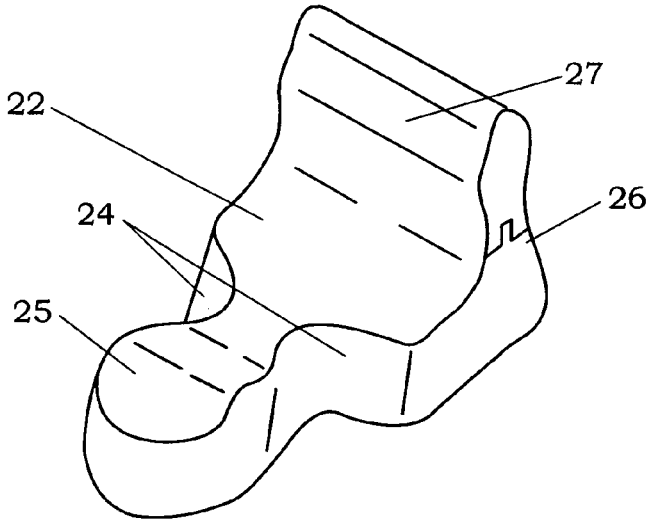
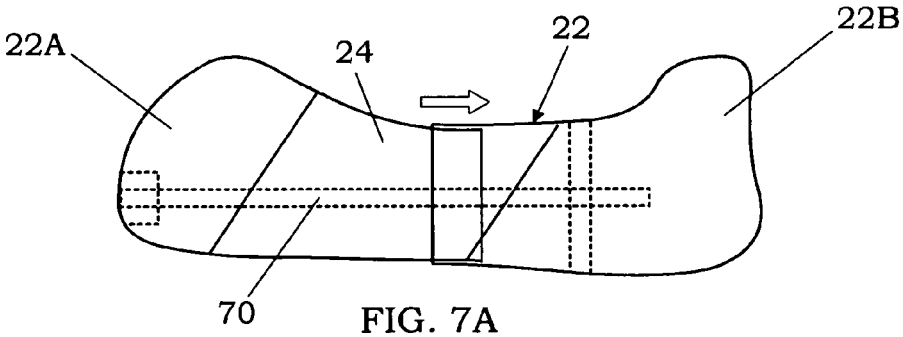
FIG. 7A
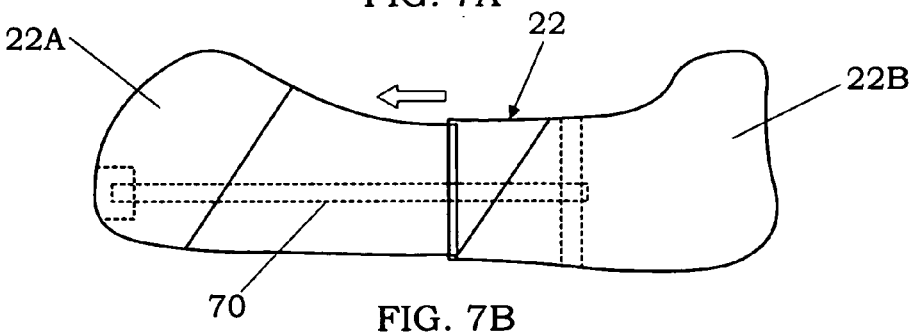
FIG. 7B

SADDLE FOR EXERCISE EQUIPMENT AND EXERCISE EQUIPMENT USING THE SAME

TECHNICAL FIELD

The present invention relates to a saddle for an exercise equipment, which has the capability of providing an exercise with the purpose of beauty exercises or overcoming lack of exercise, and is also useful for allowing a user with knee pain to perform a leg training, and an exercise equipment using the saddle.

BACKGROUND ART

It is said that aerobic exercises for reducing body fat are effective to improve lifestyle-related diseases, which have a tendency of increasing in recent years. In addition, it is considered that when sugar metabolism is enhanced by actively causing muscle contraction to improve insulin sensitivity, it contributes to improve the lifestyle-related diseases. As an exercise equipment for allowing a user to voluntarily perform an exercise, for example, a stationary cycling machines (indoor exercise bike) and a stationary running machine (treadmill) are well known. On the other hand, as another exercise equipment for allowing the user to passively perform an exercise thereby obtaining exercise effects of mainly enhancing the muscle contraction of the trunk of the body such as lumbar and back, a horse-riding exercise machine (e.g., Japanese Patent Publication [kokai] No. 11-155836) is already known.

To efficiently improve sugar metabolism by the muscle contraction, it is effective to cause the contraction of muscles having large volumes in a femoral region. However, it has been reported that diabetic patients with a high degree of obesity and elderly people are often accompanied by knee pain. Therefore, they cannot possibly perform squat exercise for effectively causing the muscle contraction at the femoral region. Even when they perform a light exercise such as walking, there is a potential for causing a clinical deterioration or an increase in knee pain. Thus, the above-described exercise equipments such as the indoor exercise bike and the treadmill are not recommended to the users with knee pain because bending and stretching exercises of knee joint are needed or a load larger than the user's own weight acts on the knee joint. On the other hand, when using the horse-riding exercise machine, the load acted on the knee joint is relatively small because the user performs an exercise in a sitting posture on a seat. However, variations in exercise effects easily occur depending on the sitting posture. In addition, since the muscle contraction is mainly caused at lumbar and back portions of the user, there is a problem that it is hard to stably obtain a desired exercise effect on the leg(s) of the user.

Thus, it is awaited to develop a new exercise equipment, which is suitable for the users having the purpose of beauty exercises or overcoming lack of exercise, and also enables the users with knee pain to safely obtain desired exercise effects.

SUMMARY OF THE INVENTION

In view of the above problems, a primary concern of the present invention is to provide a saddle, which is used for an exercise equipment for allowing a user to perform a leg exercise in a sitting posture, and has the capability of reducing variations in exercise effects caused depending on the sitting posture of the user such as sitting position and sitting direction.

That is, the exercise equipment has a base fixed in place, a support portion configured to support a part of the user's body such that at least a part of the user's own weight acts on a leg including a femoral region, and a coupling mechanism configured to movably couple the support portion to the base such that a load acted on the leg by the user's own weight varies according to a relative positional displacement between a foot position and a position of center of gravity of the user, and also configured to limit a movable direction of the support portion such that a direction of the relative positional displacement between the foot position and the position of center of gravity is limited to a direction of flexion and extension of knee joint. The saddle of the present invention supports the user's buttocks as the support portion, and has a pair of curved recesses at its outer periphery, which are configured such that parts of femoral regions of the user fit the recesses.

According to the present invention, since the saddle has the curved recesses, into which the parts of the femoral regions of the user can be fitted, it is possible to easily perform positioning of the femoral regions on the saddle, and provide an appropriate posture for a leg exercise with repeatability. As a result, there is an advantage that the exercise effects can be stably obtained by suppressing variations in sitting position and direction.

In the present invention, it is preferred that the curved recesses are configured such that an open angle between the user's legs substantially corresponds to directions of flexion and extension of left and right knee joints under the condition that the user is in a sitting posture on the saddle, and places its feet at the foot positions. More specifically, it is preferred that the curved recesses are configured such that an open angle between the user's legs is in a range of 30 degrees to 70 degrees, and particularly 60 degrees under the condition that the user is in a sitting posture on the saddle. In this case, the user can more effectively perform the leg exercise in a comfortable posture.

A further concern of the present invention is to provide an exercise equipment using the saddle described above. The exercise equipment of the present invention comprises a base fixed in place; a support portion configured to support a part of the user's body such that at least a part of the user's own weight acts on a leg including a femoral region; and a coupling mechanism configured to movably couple the support portion to the base such that a load acted on the leg by the user's own weight varies according to a relative positional displacement between a foot position and a position of center of gravity of the user, and also configured to limit a movable direction of the support portion such that a direction of the relative positional displacement between the foot position and the position of center of gravity is limited to a direction of flexion and extension of knee joint. The support portion comprises a saddle for supporting the user's buttocks. The saddle has a pair of curved recesses at its outer periphery, which are configured such that parts of femoral regions of the user fit the recesses.

Further characteristics of the present invention and advantages brought thereby will become more apparent from the best modes for carrying out the invention described below.

BRIEF EXPLANATION OF THE DRAWINGS

FIG. 1 is a schematic diagram of an exercise equipment according to a preferred embodiment of the present invention;

FIG. 2 is a top view of a saddle;

FIGS. 5A and 5B are explanatory views showing an operation of the exercise equipment with a movable footplate;

FIG. 6 is a perspective view of the saddle with a backrest;

FIGS. 7A and 7B are schematic views showing an operation of a saddle-length adjuster;

BEST MODES FOR CARRYING OUT THE INVENTION

Figure 3:
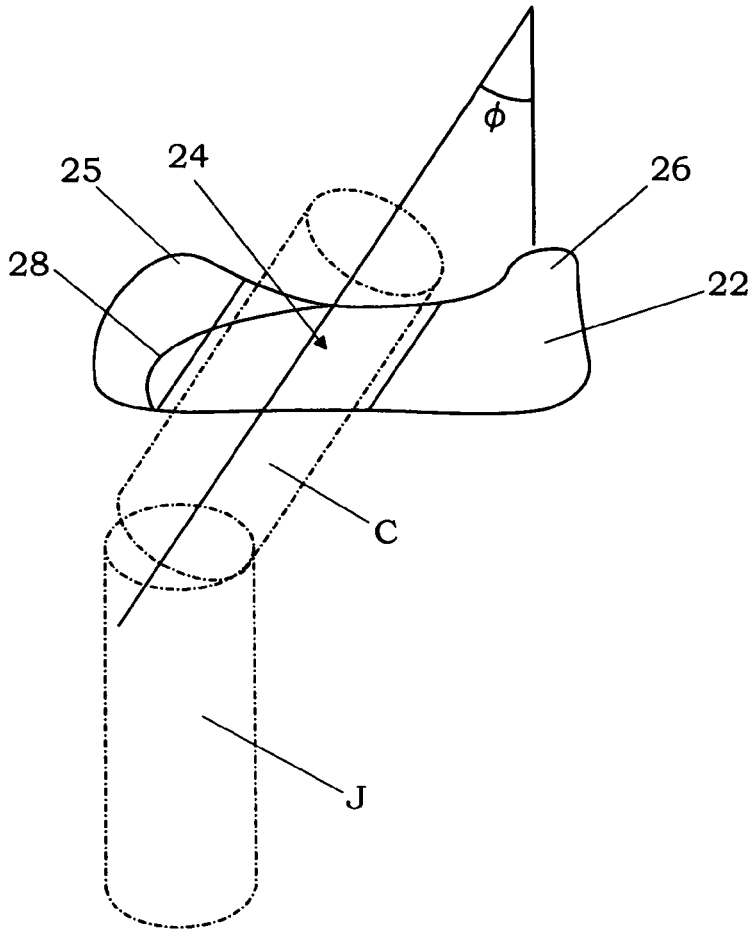
FIG. 3 is a side view of the saddle.

The present invention is explained below in detail according to preferred embodiments with reference to the attached drawings.

As shown in FIG. 1, an exercise equipment of this embodiment has a base 1 located on a floor surface, a seat member 2 for supporting user's buttocks, and a pair of footplates 3 for receiving the user's feet. The seat member 2 and the footplates 3 are mounted on the base 1 through coupling mechanisms 4, 5. Motors 6, 7 respectively connected as drive sources to the coupling mechanisms 4, 5 are controlled by a control unit 10. The motor 7 is prepared for each of the footplates 3.

The seat member 2 is provided with a post 21, a saddle 22 disposed at a top end of the post 21 to support the user's buttocks, and a joint portion 23 for joining the saddle with the post, which enables parallel and rotational movements of the saddle relative to the post. A bottom end of the post 21 is coupled to the coupling mechanism 4.

To reduce the influences of position, orientation and posture of the user sitting on the seat member on a magnitude of load applied during the exercise and a degree of knee pain of the user, the saddle 22 used in this exercise equipment has a pair of curved recesses 24 at its outer periphery, which are configured such that parts of femoral regions C of the user fit the curved recesses, as shown in FIG. 2. As the curved recess 24, for example, an outer peripheral surface of a circular cylinder may be used.

It is preferred that the curved recesses 24 are configured such that an open angle θ between the user's legs substantially corresponds to directions of flexion and extension of left and right knee joints under the condition that the user is in a sitting posture on the saddle 22, and places its feet at the footplates 3. Specifically, it is preferred that the curved recesses are configured such that the open angle between the user's legs is in a range of 30 degrees as a lower limit, at which it is suitable for the user with a stiff hip joint or a female user with shyness, to 70 degrees as an upper limit, at which the user can take a comfortable sitting posture, and particularly 60 degrees. In other words, as shown in FIG. 2, it is preferred that each of the curved recesses 24 is formed such that an angle (=θ/2) between a center axis extending in a forward and rearward direction of the saddle and a center line of the curved recess in a plan view of the saddle 22 is in a range of 15 degrees to 35 degrees, and particularly 30 degrees. In this angular range, the user can sit on the saddle in a comfortable posture. In addition, as described below, it is suitable for an exercise for applying a load alternately to the left and right legs.

In addition, it is preferred that the curved recesses 24 are configured such that an inclination angle of the femoral region C of the user relative to a vertical direction is in a range of 30 degrees to 50 degrees, and particularly 40 degrees under the condition that the user places the feet on the footplates 3 in the sitting posture on the saddle 22. In other words, as shown in FIG. 3, it is desired that the curved recess 24 is configured such that an angle ϕ between a center axis of the curved recess 24 and a virtual axis of the vertical direction in a side view of the saddle 22 is in the range of 30 degrees to 50 degrees, and particularly 40 degrees. This angle ϕ is determined according to a maximum value of knee angle, at which the knee pain hardly occurs. That is, the angle ϕ is preferably set such that the knee angle is 40 degrees under the condition that a lower leg region J (tibia) stands in the vertical direction with respect to the base 1. In this angular range, it is possible to apply the load to the knee joint with almost no knee pain. As a result, even when the user has a pain in knee joint such as osteoarthritis of knee joint, the user can comfortably perform the exercise without having to worry about clinical deterioration or knee pain.

As shown in FIG. 3, an upper surface of the saddle 22 has a smooth curved surface formed such that the center portion in the forward and rearward direction is positioned in a concave between the forward and rearward portions. In the present embodiment, for example, the upper surface of the saddle 22 is provided with a first bump 25 formed at its forward side and a second bump 26 formed at its rearward side, and the pair of curved recesses 24 are formed in a region between the first and second bumps. According to this structure, when the user sits on the saddle, the user's buttocks and pelvis are caught in a region between the first and second bumps, so that the position of the user's buttocks on the saddle can be easily determined. Therefore, it is possible to reduce variations in sitting posture and obtain stable exercise effects.

In addition, it is preferred that a forward portion of the saddle that provides the first bump 25 of the saddle 22 is detachably formed. When the first bump 25 is detached from the saddle, the upper surface of the saddle becomes a smooth curved surface configured such that the saddle forward portion is positioned to be lower than the saddle center portion having the curved recesses, and the saddle rearward portion is positioned to be higher than the saddle center portion. In this case, there is an advantage of reducing variations in sitting posture. In addition, even when the user has a disease or disability of leg joint, the user can easily get on and off the saddle 22 without lifting up the leg because the forward portion of the saddle is positioned to be lower than the center portion thereof. Furthermore, when the load acted on the user is too small, the user can apply its own weight to the leg portion to increase the exercise strength. To prevent a positional displacement of the user's buttocks during the exercise, the first bump 25 may be attached to the saddle, if necessary, after the user sits on the saddle.

It is also preferred that a center region in the forward and rearward direction of the upper surface of the saddle 22 has a flat surface for receiving the user's buttocks. In this case, since the user's buttocks are held by the flat surface with a relatively wide area, the saddle can evenly receive the weight from the user's buttocks. Therefore, it is possible to provide a comfortable exercise for an extended time period without causing a compression of coccyx and a stress concentration on a specific location of the user's buttocks such as ischial tuberosity.

In this embodiment, the coupling mechanism 4 has rotational shafts extending in the forward and backward direction and a left and right direction. For example, the post 21 is pivotally movable in the forward and backward direction about the rotational shaft extending in the left and right direction, and a joint section including the rotational shaft extending in the left and right direction is pivotally movable in the left and right direction about the rotational shaft extending in the forward and backward direction. Therefore, according to this coupling mechanism 4, a bottom end of the post 21 works as fulcrum, and the post 21 can be moved back and forth and around in an oscillating manner. In this embodiment, the coupling mechanism 4 enables the oscillating motion of the post 21 in an optional direction by use of two motors 6.

The post 21 is retractable in a height direction by forming a bottom end portion and a top end portion in a nested structure. The numeral 8 designates a motor provided as a drive source at an intermediate portion in a longitudinal direction of the post 21. By rotating this motor 8, an extensible length of the post 21 becomes changeable. In addition, the numeral 9 designates a motor provided as a drive source at the joint portion 23 between the post 21 and the saddle 22. This motor 9 enables an oscillating motion of the saddle 22 relative to the post 21 in the forward and backward direction.

The coupling mechanism 5 for the footplates 3 has pantographs 51 disposed on the base 1, and the footplates 3 are mounted on the pantographs 51. The numeral 7 designates motors provided as drive sources in the coupling mechanism 5. By rotating the motors 7, the pantographs 51 are elongated and contracted, so that up and down movements of the footplates 3 are obtained.

In brief, the seat member 2 can be moved back and forth and around in the oscillating manner by the motors 6. The up and down movement of the footplates 3 can be obtained by the motors 7. The extension and contraction of the post 21 can be obtained by the motor 8. The motor 9 enables an angular adjustment of the saddle 23 relative to the post 21 in the forward and backward direction. Since two motors 6 are used for the seat member 2, and two motors 7 are used for the footplates 3, the total of six motors 6 to 9 are controlled to obtain a combination of the above-described motions. As described before, each of the motors 6 to 9 is controlled by the control unit 10 having a microcomputer as the main component. In the control unit 10, plural sets of time-series data for rotational angle of each of the motors 6 to 9 are installed to obtain an appropriate exercise load. Therefore, it is possible to provide a desired operation by selecting an appropriate set of time-series data.

The motors 6 to 9 are selectively driven in accordance with the kind of exercise. Basically, the motors 6 are always driven to provide the oscillating motion of the seat member 2. When the seat member 2 is oscillated, the other motors 7 to 9 may be stopped. Preferably, at least one of the motors 7 for the footplates 3 and the motor 9 for the saddle 22 is activated in synchronization with the motors 6 for the seat member 2.

The above-described exercise equipment is operated under the condition that the user sits on the saddle 22, and places the feet on the footplates 3. In the sitting posture on the saddle 22, it is needed that the user's soles contact the footplates 3. By adjusting at least one of height positions of the footplates 3 and the extensible length of the post 21, a positional relation between the footplates 3 and the saddle 22 can be changed according to the leg length of the user.

When the seat member 2 is oscillated under the condition that the user sits on the saddle 22, the position of center of gravity of the user is displaced relative to the foot position of the user. When the user sits on the seat member 2, the center of gravity of the user is located at a slightly forward position of the user's buttocks. Then, when the seat member 2 is inclined forward from an upright position, the position of center of gravity of the user is displaced forward, so that a ratio of the load acted on the user's leg including the femoral region relative to the user's own weight increases. In addition, when the seat member 2 is inclined in the left and right direction of the user, the user's own weight is mainly acted on one of the user's legs, which is positioned at the inclined side of the seat member 2. Thus, since the saddle 22 receives a part of the user's own weight, and the load acted on the leg (particularly, the femoral region having relatively high volume muscles) is changed by the oscillating motion of the seat member 2, it is expected to enhance muscle metabolism and improve insulin resistance. Furthermore, since the load is acted on the femoral region having higher volume muscles than the other regions, it is possible to efficiently realize the muscle metabolism.

By the way, when the user has knee pain, the motors 6 are driven such that the oscillating direction of the seat member 2 (i.e., a direction of the relative positional displacement between the position of center of the gravity of the user and the foot position on the footplate 3) is limited to a direction of flexion and extension of knee joint. That is, a displacement direction of the center of gravity of the user becomes parallel to the direction of flexion and extension of knee joint of the user. For example, when the time-series data of the motors 6 is installed in the control unit 10 such that the oscillating motion of the seat member 2 is provided in the direction of flexion and extension of knee joint, the coupling mechanism 4 limits the oscillating direction of the seat member 2. In the case of driving the motors 6, it is preferred to limit the movable range of the seat member 2 such that a range of flexion and extension of knee joint is a certain angle, e.g., 40 degrees from an extended position. Thus, the direction of flexion and extension of knee angle is limited without torsion of knee joint, and also the (angular) range of flexion and extension of the knee joint is limited. Therefore, even when the user has a pain in knee joint such as osteoarthritis of knee joint, the user can safely perform the exercise, while avoiding a clinical deterioration or an increase in knee pain.

As described above, to limit the oscillating direction of the seat member 2 to the direction of flexion and extension of knee joint, it is preferred that the user determines the foot position and the toe direction on the footplate 3, or the foot position and the toe direction are detected by use of a sensor in addition to controlling the oscillating direction of the seat member 2. In this embodiment, a mark for allowing the user to easily determine the foot position and the toe direction is provided on the footplate 3. Therefore, the user can determine the foot position and the toe direction by simply placing the foot on the footplate 3. In addition, it is further effective to use the footplate 3 with a toe clip portion such as a top end portion of slipper or sandal.

Figure 4A:
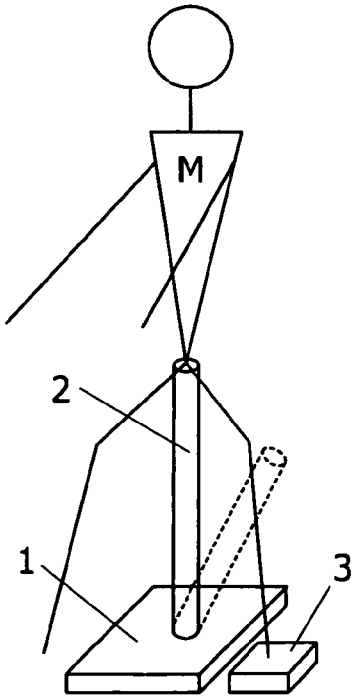
FIGS. 4A and 4B are explanatory views showing an operation of the exercise equipment.
Figure 4B:
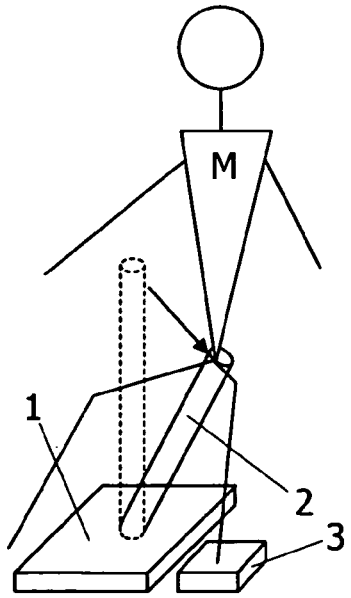

The following explanation is directed to a case that an exercise be performed by applying a load to only one leg. That is, only one leg is placed on one of the footplates 3. In this state, the coupling mechanism 4 presents the oscillating motion of the seat member 2 in two planes respectively including a portion for supporting the user's buttocks and the second toe of each of the user's legs. For example, as shown in FIG. 4A, when the seat member 2 is in a substantially upright posture against the base 1, a larger load is acted on the seat member 2 than the footplate 3 by the user's own weight. On the other hand, as shown in FIG. 4B, when the seat member 2 is in an inclined posture to the base 1, the load acted on the footplate by the user's own weight increases, as compared with the case of FIG. 4A. That is, the load acted on the femoral region by the user's own weight becomes larger in the case of FIG. 4B than the case of FIG. 4A. In FIG. 4B, since the seat member 2 still receives a part of the user's own weight, it is a relatively light exercise, as compared with the case of performing squat exercise by using all of the user's own weight. Thus, the exercise equipment becomes available to user having disorders of knee joint by adjusting the load acted on the knee joint. In addition, since the flexion and extension of the knee joint enables without torsion, a clinical deterioration or an increase in knee pain can be prevented. A maximum inclination angle of the seat member 2 is preferably 3 to 5 degrees. In addition, the number of oscillating motions per second of the seat member 2 is preferably 0.3 to 2 times. These values are based on experimental results.

In addition, to efficiently apply the load to one of the user's legs, it is preferred to incline the seat member 2 from a substantially upright posture of the seat member 2 relative to the base 1 toward one of the left and right footplates 3, and simultaneously move one of the footplates 3, which is located at the inclined side of the seat member 2, in a downward direction. Alternatively, the other one of the footplates 3, which is located at a side opposed to the inclined side of the seat member 2, may be moved in a slightly upward direction. In this case, a larger load can be acted on the user's leg located at the inclined side of the seat member 2 by the inclination of trunk of the user's body. That is, a relatively large load can be applied to the femoral region by a relatively small inclination angle of the seat member 2. As a result, a ratio of the load acted on the leg relative to the energy for inclining the seat member 2 increases. Thus, it is possible to efficiently apply the load to the leg. In the above explanation, the oscillating motion of the seat member 2 may be repeated for only one of the left and right legs. Alternatively, the seat member 2 may be inclined alternately for the left and right legs. The above-explained operation can be achieved by controlling the motors 6 for inclining the seat member 2 in synchronization with the motor(s) 7 for moving the footplate(s) 3 in the upward and downward direction.

In the present embodiment, since the exercise equipment has the pair of footplates 3 for receiving both legs, the oscillating direction of the seat member 2 can be limited with respect to each of the legs such that the direction of the relative positional displacement between the foot position and the position of center of gravity is in agreement with the direction of flexion and extension of knee joint. That is, the user places the feet on the footplates 3 under the condition that the user's legs are opened at the above-described angle. Then, the seat member 2 is oscillated between a position where the seat member 2 is in the upright posture against the base 1 and a position where the seat member 2 is inclined in a forward left or forward right direction. Therefore, it is different from the case of oscillating the seat member 2 simply in the forward and backward direction. Consequently, this motion of the seat member 2 enables alternately applying the load to the user's legs in such a manner that when one of the legs receives the exercise, the other leg is in rest position. In addition, as compared with a case that the load is evenly applied to the user's legs kept in parallel to each other, the maximum load to be applied can be increased (for example, the maximum load is 50% or more of the user's own weight). Moreover, when the load is applied to both legs kept in parallel to each other, there is a case that the load applied to one of the legs becomes larger than the load applied to the other leg due to a difference in muscle strength between the left and right legs or a difference in degree of knee pain, so that the load can not be uniformly applied to the both legs. In such a case, by applying the load alternately to the left and right legs, it is possible to provide an appropriate exercise to each of the legs. Under the condition that the footplates 3 are kept at fixed positions, or the user places the feet in parallel on the base 1, the load can be simultaneously applied to the both legs by oscillating the seat member 2 in the forward and rearward direction.

As described above, the respective footplate 3 is movable relative to the base 1 in the up and down direction, and the motion of the footplate 3 can be controlled in synchronization with the oscillating motion of the seat member 2. That is, FIG. 5A shows a position of the footplate 3 when the seat member 2 is in the substantially upright posture, and FIG. 5B shows a position of the footplate 3 when the seat member 2 is in the inclined posture. From these figures, it can be understood that the footplate 3 is positioned at a lower position in the inclined posture of the seat member 2. Such a control can be achieved by controlling the motor 6 for tilting the seat member 2 in synchronization with the motors 7 for moving the footplates 3 in the up and down direction.

In addition, when the seat member 2 is inclined, the footplate 3 located at a side opposed to the inclined side of the seat member 2 may be moved in a slightly upward direction. When using such a motion, it is possible to apply a larger load to the user's leg located at the inclined side of the seat member 2 by inclining the trunk of the user's body. That is, since a relatively large load can be acted on the leg by a reduced inclination angle of the seat member 2, a ratio of the load acted on the leg relative to the energy for inclining the seat member 2 increases to efficiently provide the exercise to the leg. The oscillating motion of the seat member 2 can be repeated for one of the left and right legs. Alternatively, the oscillating motion may be provided alternately for the left and right legs.

Thus, when the footplate 3 is moved downward as the inclination angle of the seat member 2 increases, the load acted on the user's leg can be adjusted by the user's own weight without substantially changing the bending angle (knee angle) of the knee joint. That is, since the leg muscles are contracted in an almost isometric contraction manner, it is possible to obtain the muscles contraction with less load acted on the user's knee. In addition, since the seat member 2 and the footplates 3 are driven by the motors 6, 7, the user can obtain high exercise effects by simply following the motions of the seat member 2 and the footplates 3 without actively moving its body. Moreover, it is experimentally confirmed that the user with osteoarthritis of knee joint can perform an exercise without being accompanied by hard pain when the knee angle is 40 degrees or less. As the knee angle becomes closer to 90 degrees, the user can easily sit on the saddle 22, and a larger load (rotational moment) can be efficiently applied to the femoral region. In this case, therefore, it can be said that the knee angle is preferably 40 degrees.

A structure of the footplate is not limited. For example, the seat member 2 can be mechanically coupled to the footplates 3. In addition, it is preferred that a single spring member is disposed under the footplate, and a spring constant of the spring member is determined such that a desired descent amount of the footplate is obtained in response to a magnitude of the load. Moreover, the descent amount may be adjusted by use of a plurality of spring members with different spring constants in response to the magnitude of the load (e.g., by use of a 2-stage spring having a nonlinear spring constant). Alternatively, an appropriate descent amount may be determined by selectively changing the number used of a plurality of springs having the same spring constant in response to the user's body weight or a target load. Furthermore, the descent amount of the footplate may be adjusted by controlling an air amount of an air piston disposed under the footplate in response to the user's body weight or an instantaneous value of the load. In addition, the position of the footplate may be controlled by expanding and contracting an airbag or an air tube disposed under the footplate in response to the load applied to the footplate. In these cases, the motors for the footplates 3 are not needed.

The saddle 22 may be slidable in a direction (i.e., forward and rearward direction) in a plane intersecting with an axial direction of the post 21 in place of changing the inclination angle of the saddle 22 relative to the top end of the post 21 in the forward and rearward direction. In this structure, the motor 9 enables the slide movement of the saddle 22 relative to the post 21. As the inclination angle of the seat member 2 increases, the saddle 22 is slid in the forward direction, so that the user's buttocks are moved forward. At this time, since the user is kept in an almost standing posture, it is possible to increase the load acted on the leg. In the above structure, the inclination angle of the seat member 2 relative to the base 1, the position of the footplate 3 relative to the base 1, the extensible length of the seat member 2 and the position of the saddle 22 relative to the post 21 are controlled by use of the motors 6 to 9. Alternatively, the inclination angle of the seat member 2 may be controlled in synchronization with a positional change of the saddle 22 relative to the post 21. In this case, the motor 9 for moving the saddle 22 can be omitted.

As a modification of this embodiment, as shown in FIG. 6, it is preferred that a backrest 27 is detachably attached to a rear portion of the saddle 22. In this case, since the user's waist contacts the backrest 27 when the user sits on the saddle, it is possible to prevent a situation that the upper half of the user is inclined rearward, and suppress variations in sitting posture. A means for detachably attaching the backrest 27 to the saddle 22 is not limited. For example, a separable hinge is provided at the forward portion of the backrest 27, and a rear surface of the backrest 27 is secured to the rear surface of the saddle 22 by use of a belt and a buckle. In addition, when using the saddle with the backrest 27, it is possible to apply a relatively large load to the user, while appropriately keeping the posture of the user. On the contrary, when the load applied to the user is too much, it can be reduced by removing the backrest 27 from the saddle.

As another modification of this embodiment, as shown in FIGS. 7A and 7B, it is preferred that the saddle 22 has a saddle-length adjuster for changing the saddle length in the forward and rearward direction. In this case, even when the user has a thick femoral region, it can be comfortably fitted into the curved recess 24 by extending the saddle length. Therefore, irrespective of the user's figure, it becomes easy to perform the exercise under the condition that the user's legs are opened at a required angle. In addition, it is effective to appropriately keep the sitting posture of the user during the exercise. For example, the saddle-length adjuster of this embodiment is formed with a pair of parts (22A, 22B) that are separable from each other in the forward and rearward direction, and a screw member 70 for coupling between these parts. By rotating the screw member 70 at the forward side of the saddle, an insertion amount of the part 22A in to the part 22B can be adjusted to change the saddle length.

Figure 8A:
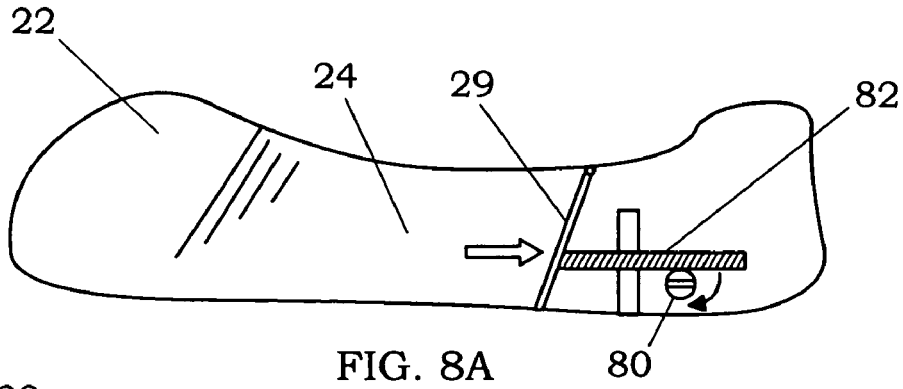
FIGS. 8A and 8B are schematic views showing an operation of a saddle-angle adjuster.
Figure 8B:
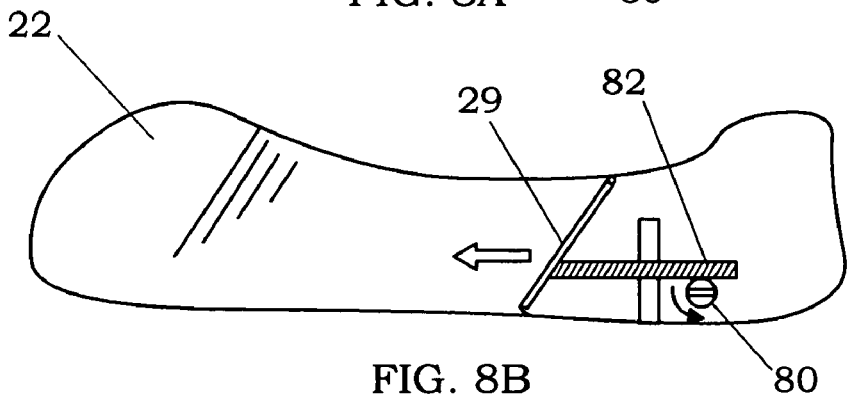

In addition, as shown in FIGS. 8A and 8B, it is preferred that the saddle 22 has an angle adjuster for changing an inclination angle of an inner surface 29 of the curved recess 24. According to this structure, even when it is hard to fit the femoral region of the user into the curved recess 24 due to the shape of user's buttocks, the fitting condition can be improved by adjusting the inclination angle of the inner surface 29 of the curved recess 24. For example, according to the angle adjuster of this embodiment, when screw members (80, 82) provided at a side surface of the saddle 22 are rotated, as shown in FIG. 8A, an angle between the inner surface 29 and the vertical direction can be reduced to obtain a steep inclination of the inner surface 29. On the contrary, when the screw members (80, 82) are rotated, as shown in FIG. 8B, the angle between the inner surface 29 and the vertical direction can be increased to obtain a gentle inclination of the inner surface 29.

Figure 9A:
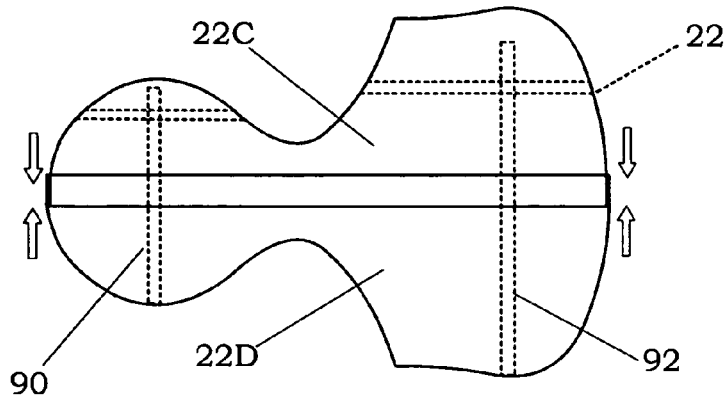
FIGS. 9A to 9D are schematic views showing an operation of a saddle-width adjuster.
Figure 9B:
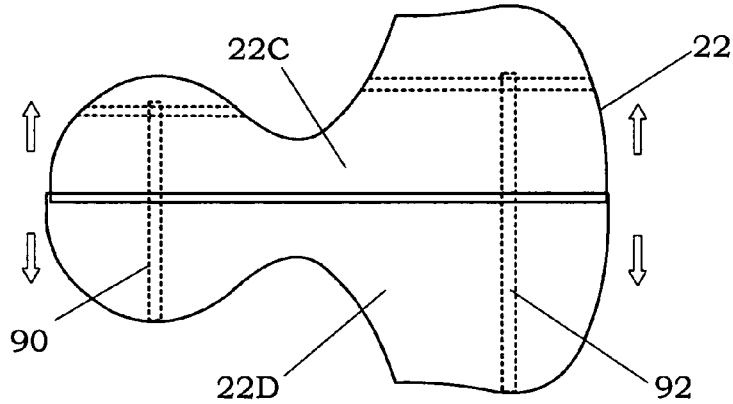
Figure 9C:
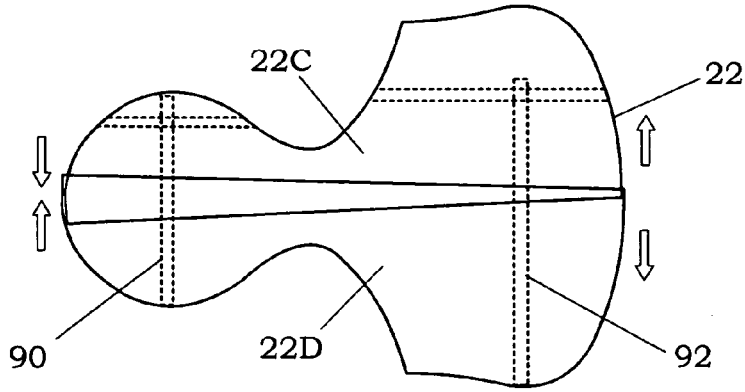
Figure 9D:
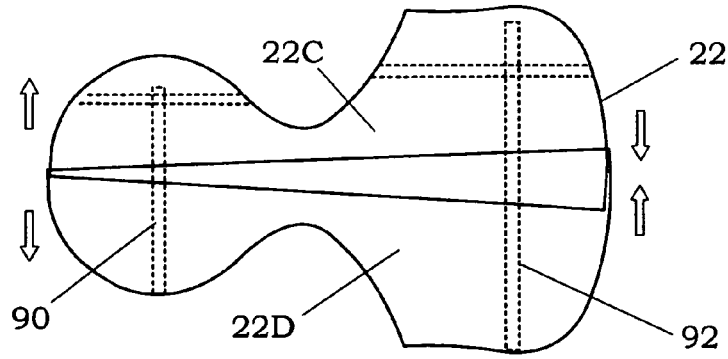

In addition, as shown in FIGS. 9A and 9B, it is preferred that the saddle 22 has a saddle-width adjuster for changing the saddle width in the left and right direction. In this case, it is possible to obtain a buttock supporting area suitable for the user's figure, and also provide a comfortable, stable sitting posture under the condition that the user sits on the saddle 22, and the user's feet are placed on the footplates 3. For example, as the saddle-width adjuster of this embodiment, the saddle 22 is formed with a pair of parts (22C, 22D) that are separable from each other in the left and right direction, and a pair of screw members (90, 92) for coupling between these parts. As shown in FIG. 9A, when both of the screw members (90, 92) are rotated in the same direction at a side of the saddle, an insertion amount of the part 22C in the part 22D can be increased to reduce a top surface area of the saddle as a whole. On the other hand, as shown in FIG. 9B, when both of the screw members (90, 92) are rotated in a direction opposed to the direction in the case of FIG. 9A, the insertion amount of the part 22C in the part 22D can be reduced to increase the top surface area of the saddle as a whole. In addition, as shown in FIGS. 9C and 9D, when one of the screw members (90, 92) is rotated in a direction, and the other screw member is rotated in the opposite direction, it is possible to increase only the top surface area of a rearward portion of the saddle (FIG. 9C), or increase only the top surface area of a forward portion of the saddle (FIG. 9D). Thus, it is possible to obtain the buttock supporting area suitable for the user's figure.

Figure 10A:
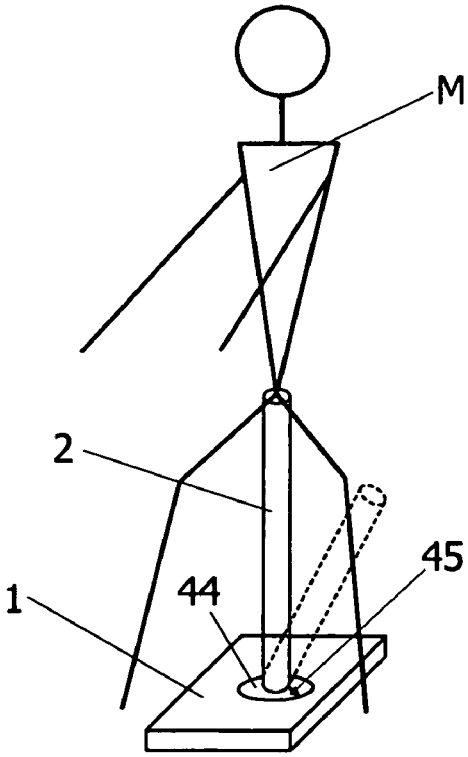
FIGS. 10A and 10B are explanatory views showing an operation of the exercise equipment with no movable footplate.
Figure 10B:
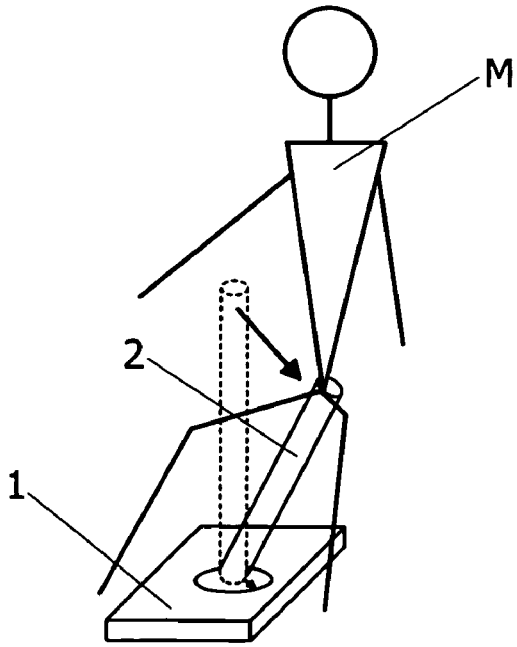

As described above, the exercise equipment of this embodiment has the footplates 3. However, the footplates may be omitted. For example, in an exercise equipment with no footplate shown in FIGS. 10A and 10B, the seat member 2 can be inclined relative to the base 1 by use of a coupling mechanism. In this case, the user M sitting on the saddle (not shown) of the seat member 2 can place the feet on the base 1 or a floor. In this case, a direction indicating plate 44 is mounted on the base to be rotatable in a plane parallel to the top surface of the base 1, and an arrow mark 45 is provided on the direction indicating plate 44. By allowing the user to place the foot on an extended line of the arrow mark 45, it is possible to match the oscillating direction of the seat member 2 with the direction of flexion and extension of knee joint. The figure shows that the seat member 2 is oscillated in only one direction. As a modification, the seat member 2 may be oscillated in two directions such that the load is applied alternately to the left and right legs.

The saddle of the present invention may be utilized in a horse-riding exercise machine other than the above equipment. The sitting position and posture can be stably kept by positioning the femoral region of the user in place. Consequently, it is possible to suppress variations in horse-riding exercise effects.

INDUSTRIAL APPLICABILITY

As described above, according to the exercise equipment using the saddle of the present invention, it is possible to cause a muscle contraction of the femoral region, which is effective to enhance sugar metabolism of the user, by efficiently applying a load to muscles of the leg including the femoral region of the user in a sitting posture on the saddle. In addition, since the saddle has the pair of curved recesses, to which parts of the femoral regions of the user can be fitted, it is possible to reduce variations in exercise effects dependent on the sitting posture.

Thus, the saddle of the present invention enables the exercise equipment, which is suitable for prevention/improvement of lifestyle-related diseases or beauty/dieting exercises, and also stably provides appropriate exercise effects to the users with knee diseases or having need of rehabilitation exercises. Therefore, the saddle and the exercise equipment using the same are expected to be widely used in the future.

The invention claimed is:

1. An exercise equipment comprising:

a base fixed in place; and a support portion configured to support a part of a user's body such that at least a part of the user's own weight acts on a leg including a femoral region, wherein said support portion comprises a saddle for supporting the user's buttocks, and said saddle has a pair of curved recesses at its outer periphery, which are configured such that parts of femoral regions of the user fit said curved recesses, wherein the exercise equipment further comprises:

a control unit;

a drive source controlled by the control unit; and a coupling mechanism to which the drive source is connected, and wherein the coupling mechanism is configured to movably couple said support portion to said base such that a load acted on said leg by the user's own weight varies according to a relative positional displacement between a foot position and a position of a center of gravity of the user, and also configured to limit a movable direction of said support portion such that a direction of the relative positional displacement between the foot position and the position of center of gravity is limited to a direction of flexion and extension of a knee joint of the user, wherein the saddle is oscillated between a position where the saddle is in the upright posture perpendicular to the base and a position where the saddle is inclined and angled relative to the base in at least forward left and forward right directions in front of the user when the user is sitting on the saddle.

2. The exercise equipment as set forth in claim 1, wherein said curved recesses are configured such that an open angle between the user's legs substantially corresponds to directions of flexion and extension of left and right knee joints under the condition that the user is in a sitting posture on the saddle, and places its feet on the foot positions.

3. The exercise equipment as set forth in claim 1, wherein said curved recesses are configured such that an open angle between the user's legs is in a range of 30 degrees to 70 degrees under the condition that the user is in a sitting posture on the saddle.

4. The exercise equipment as set forth in claim 1, wherein said curved recesses are configured such that an inclination angle of the femoral region of the user relative to a vertical direction is in a range of 30 degrees to 50 degrees under the condition that the user is in the sitting posture on the saddle.

5. The exercise equipment as set forth in claim 1, wherein the saddle comprises a first bump formed at its forward side and a second bump formed at its rearward side, wherein said curved recesses are provided between the first and second bumps.

6. The exercise equipment as set forth in claim 1, wherein a forward portion of the saddle is positioned to be lower than a saddle center portion with said curved recesses, and a rearward portion of the saddle is positioned to be higher than said saddle center portion.

7. The exercise equipment as set forth in claim 1, wherein the saddle further comprises a backrest detachably attached to a rear portion of the saddle.

8. The exercise equipment as set forth in claim 1, wherein the saddle further comprises a saddle-length adjuster configured to change a length of the saddle in a forward and rearward direction.

9. The exercise equipment as set forth in claim 8, wherein the saddle is symmetrical along an axis in the length direction.

10. The exercise equipment as set forth in claim 1, wherein the saddle further comprises a saddle-width adjuster configured to change a length of the saddle in a width direction.

11. The exercise equipment as set forth in claim 10, wherein the saddle is symmetrical along an axis in the length direction.

12. The exercise equipment as set forth in claim 1, wherein the saddle further comprises an angle adjuster configured to change an inclination angle of an inner surface of said curved recess.

13. The exercise equipment as set forth in claim 1, wherein an open angle between the user's legs is in a range of 30 degrees to 70 degrees, and the open angle substantially corresponds to directions of flexion and extension of left and right knee joints under the condition that the user is in a sitting posture on the saddle, and places a foot on the foot position.

* * * * *